US005218985A

United States Patent [19]

Berger et al.

[11] Patent Number: 5,218,985

[45] Date of Patent: Jun. 15, 1993

[54] METHOD AND APPARATUS FOR ELIMINATING UNEQUAL PHASE SPLITTING AT PIPING JUNCTIONS

[75] Inventors: Eric L. Berger, Bakersfield, Calif.; James R. Stoy, Missouri City, Tex.; Mark T. Rubel, Houston, Tex.; James L. G. Schrodt, Houston, Tex.

[73] Assignee: Texaco Inc., White Plains, N.Y.

[21] Appl. No.: 962,541

[22] Filed: Oct. 19, 1992

[51] Int. Cl.[5] ..... F10T 1/00

[52] U.S. Cl. ..... 137/8; 137/171; 137/599

[58] Field of Search ..... 137/1, 8, 599, 171, 137/154, 2, 3

[56] References Cited

U.S. PATENT DOCUMENTS

| | | | |
|---|---|---|---|
| 403,704 | 5/1889 | Stuart | 137/171 |
| 3,345,803 | 10/1967 | Smith | 137/171 X |
| 3,416,547 | 12/1988 | Glenn | 137/171 X |
| 3,685,534 | 8/1972 | Straitz | 137/171 |
| 3,952,765 | 4/1976 | Kimura | 137/171 |
| 4,522,218 | 6/1985 | Konak | 137/599 X |
| 4,574,827 | 3/1986 | Konak | 137/599 X |
| 4,987,918 | 1/1991 | Barnadas | 137/171 |

*Primary Examiner*—Alan Cohan

*Attorney, Agent, or Firm*—James L. Bailey; Jack H. Park; Russell J. Egan

[57] ABSTRACT

The separation of wet steam into its liquid and vapor phases, prior to encountering a pipe junction, is facilitated. The liquid phase is then recombined by aspiration to effectively behave as a single phase vapor of homogeneous density at the point where the flow stream is divided by the junction.

8 Claims, 1 Drawing Sheet

METHOD AND APPARATUS FOR ELIMINATING UNEQUAL PHASE SPLITTING AT PIPING JUNCTIONS

BACKGROUND OF THE INVENTION

1. The Field of the Invention

The present invention relates to a method and apparatus for substantially eliminating unequal phase splitting of wet steam at piping junctions and, in particular, to a system which separates the liquid and vapor phases upstream of the junction and then recombines them at the inlet of a piping junction.

2. The Prior Art

There is a need for a simple method and apparatus to control phase splitting which occurs at piping junctions in wet steam distribution systems, particularly at impacting T-junctions. Such an apparatus, if simplified, would be particularly useful in controlling steam quality and thereby the amount of heat which is available since more heat is transmitted by the vapor phase of the steam than by the liquid phase.

Generally, as pressurized wet steam flow flows through a piping system, there is a tendency for the steam to separate into its vapor and liquid phases. The separation occurs with the heavier and slower liquid phase becoming annular and adhering to the piping walls while the lighter and faster gaseous phase moves axially through the piping. This results in steam of unequal quality coming off, for example, the arms of an impacting T-junction.

It is important, therefore, as a matter of economic practicality that a means be instituted in the steam pipeline to prevent unwanted phase separation and promote homogeneity of the steam, particularly where it comes into and out of piping junctions.

Phase splitting is a phenomena of two phase vapor (or gas) and liquid flow that occurs at all piping junctions such as impact T's, branch T's, Y's, crosses, manifolds, etc. In standard junctions the liquid and vapor phases do not diverge in equal mass proportions except in junctions with symmetrical flow, such as in impact T's where the vapor mass rates are equal in each junction outlet (a vapor extraction ratio of 0.5). This is important, for example, in steamflood distribution systems, used for enhanced oil recovery, where it is desirable to deliver nearly equal steam quality throughout the entire distribution system. Steam quality is a measure of the proportion of the total mass that is vapor. The vapor extraction ratio is defined below.

Vapor Extraction Ratio is, $$F_{g3} = \frac{M_{v3}}{M_{v3} + M_{v2}} = \frac{M_{v3}}{M_{v1}}$$

where, $F_{g3}$ = Vapor Extraction Ratio $M_{v1}$ = Inlet mass rate of the vapor phase $M_{v2}$ = Outlet branch 2 mass rate of vapor phase $M_{v3}$ = Outlet branch 3 mass rate of vapor phase Numerous studies investigating phase splitting have been conducted and various devices to equalize or control phase splitting have been tried. However, only a few of these ideas have been implemented in the design of new steam distribution systems and none have become standard practice throughout the industry. Still fewer of these methods are commonly encountered as "fixes", to minimize or control phase splitting, in distribution systems which were built before phase splitting was widely understood. The method disclosed here meets the criteria required of a "fix" in that it requires no operator action, creates minimal pressure drop, and is both inexpensive and effective.

An example of where the present invention would be particularly useful is secondary recovery of hydrocarbons from marginal fields or heavy oil reserves that require a degree of stimulation to achieve satisfactory flow of crude petroleum. In such operations steam is sent through a patterned array of injection wells to heat the formation being treated and drive the hydrocarbons towards a production well. The steam quality will directly affect the formation heatup effect and thus the efficiency of the recovery operation. The vapor phase of the steam will have the most heat and therefore have the greatest effect on the formation. Thus it is desirable to have steam of uniform quality injected into all portions of the formation.

SUMMARY OF THE INVENTION

The present invention substantially eliminates unequal phase splitting at piping junctions. The present invention provides means to facilitate separation of the liquid and vapor phases and then acts as a mixer creating a homogeneous mixture as the liquid phase is aspirated and dispersed into the vapor stream. The present invention introduces very little additional pressure drop into the system.

BRIEF DESCRIPTION OF THE DRAWINGS

The present invention will now be described, by way of example, with reference to the accompanying drawings in which:

FIG. 2 is a horizontal section through the present invention taken along line 2—2 of FIG. 1; and.

DESCRIPTION OF A PREFERRED EMBODIMENT OF THE INVENTION

Figure 1:
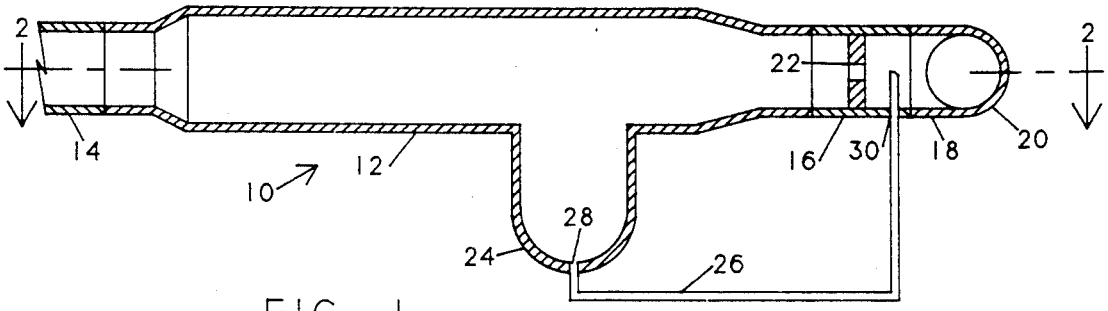
FIG. 1 is a vertical section through the device according to the invention, taken along line 1—1 of FIG. 2.
Figure 2:
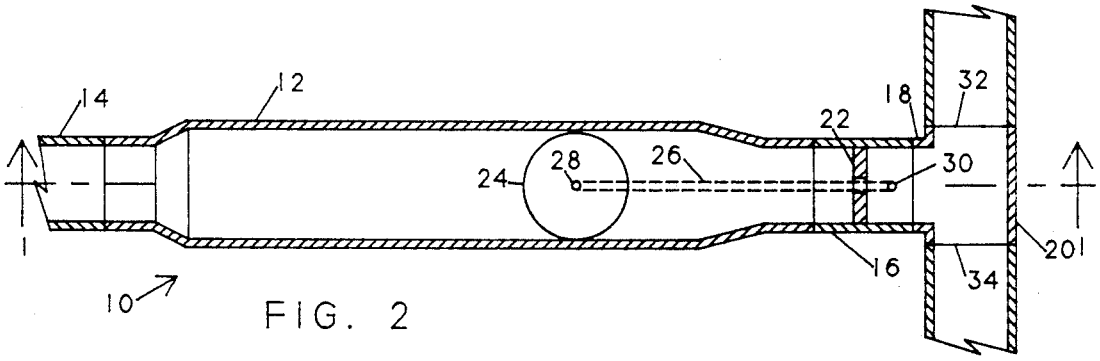

The invention 10 has a phase separator 12, here shown as a large diameter section of pipe sufficient to allow separation of the liquid and vapor phases, connected between a flow pipe 14 and outlet pipe 16 leading to an inlet arm 18 of a horizontal impact T junction 20. The outlet pipe 16 contains a constriction 22, such as an orifice plate, fixedly mounted upstream of the junction 20. The phase separator 12 contains a sump 24 with a small diameter pipe 26, such as ½" tubing, connected between an outlet 28 on sump 24 to an inlet 30 in the outlet pipe 16 immediately downstream of the constriction 22.

The phase separator 12 serves to promote the complete separation of the liquid and vapor components of the wet steam by substantially reducing the velocity of the steam and allowing gravity to cause the actual separation of the two phases. The vapor phase moves axially through the large diameter section exiting through outlet pipe 16 and constriction 22, which is placed in close proximity to, but upstream of, the inlet 18 of the horizontal junction 20. The Figures depict an impact T junction, though other types of junction are possible, provided they are laterally symmetrical and offer no preferential path for the steam to follow (no "path of least resistance" as it were). The liquid phase of the separated steam leaves the large diameter portion of separator 12 dropping vertically downward, under the influence of gravity, to sump 24 and subsequently flows through small diameter pipe 26 to the inlet 28 where the small diameter pipe 26 passes through the wall of the outlet pipe 18 immediately downstream of the flow constriction 22. The flow of high velocity steam vapor through the constriction 22 causes a low pressure region to occur immediately downstream of the constriction 22 (vena contracta) at the same point where the small diameter pipe 26 enters the outlet flow pipe 16. The existence of this low pressure region forces the liquid phase to be drawn forcibly into the high velocity vapor stream causing the liquid to form tiny droplets which become entrained in the flowing vapor. The liquid droplets are then carried with the vapor as it enters the horizontal impact T junction 20. Because the tiny droplets are finely dispersed in the vapor stream, the two phase steam behaves as a single phase fluid of homogeneous density. The "fog" or "spray" flow stream is then divided into two separate flow streams by the T junction 20. The two resulting steam streams, because the liquid and vapor phases are thoroughly mixed, leave the arms 32, 34 of T junction 20 at substantially equal steam qualities.

The shape and location of the end of the small diameter pipe 26 has been found to be of importance in optimizing the performance of the present invention. Experimentation has shown that the most effective location for the small pipe 26 is to have its open end located substantially aligned with the center of the constriction 22. Further, the performance of the device has been found to be best if the shape of the open end of the pipe 26 conforms to the diagram in FIG. 3.

The present invention substantially eliminates the effect of phase splitting at impact T piping junctions with minimal pressure loss to the steam. The invention can also be applied to junctions with more than 2 outlets, provided that the multiple outlets are configured in such a way that there exists no "preferential path" for the steam to exit the junction. The invention performs this function by first separating the steam into its liquid and vapor components and conducting each component separately to a location immediately upstream of an impact T or other laterally symmetrical junction where they are recombined in such a fashion to cause substantial mixing of the two components to occur. The remixed steam then behaves as a single phase vapor of homogeneous density at the point where the flow stream is divided into the exit branches of the junction. The mixing of the two components is accomplished through the application of the same principle as that used to cause the atomization of liquids into a spray in a perfume atomizer, namely, aspiration.

Figure 3:
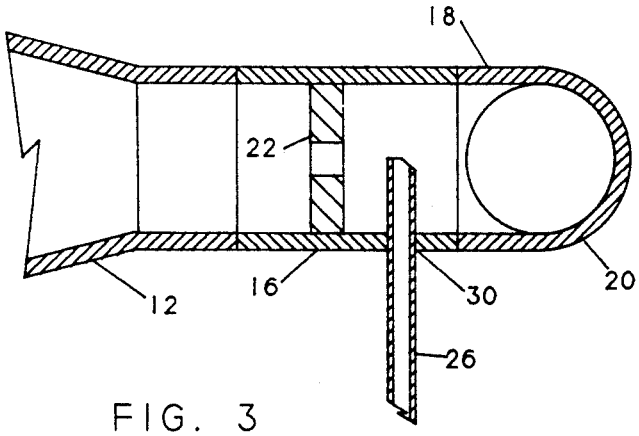
FIG. 3 is a detailed vertical section, similar to FIG. 1, showing the liquid-vapor mixing portion of the present invention.

The shape and location of the ends of the small diameter pipes 32, 34 has been found to be of importance in optimizing the performance of the present invention. Experimentation has shown that the most effective location for the ends of the pipes is substantially aligned with the axis of the respective constriction 22, 24. Further, the performance of the device has been found to be best if the shape of the open ends of the pipes 32, 34 is as shown in FIG. 3.

The square root of the pressure drop created by the constriction is directly proportional to mass rate of vapor. The mass flow rate of liquid entering each outlet branch through the liquid bypass lines is also a function of the square root of the pressure drop created by the flow constrictions. Thus the flow rate of liquid entering each outlet branch is directly proportional to the vapor flow rate in each branch. The result is a system which is self compensating with respect to changes in the vapor extraction ratio.

Any means of separating the liquid and vapor phases upstream of the junction can be used. However large diameter piping, which reduces the velocity sufficiently to achieve stratified flow, can be used effectively, at low cost, without the requirements of a coded pressure vessel. Once separated the liquid phase is directed through relatively small diameter junction bypass piping to each junction outlet downstream of the outlet flow constriction.

The vapor phase flows predominately axially through the piping junction. The present invention is not limited to impact or branch T junctions but could also be used with a manifold having any number of outlets, as long as a junction bypass and a flow constriction is provided for each outlet. Since only single phase vapor passes through the junction, phase splitting cannot occur within the junction.

The sizing of the separator, the vapor flow constriction, and the junction bypass line define the range of flow conditions over which the device works effectively. The sizing of the vapor flow constriction relative to the diameter of the junction bypass pipe must allow the vapor phase to flow predominately through the junction while permitting all of the liquid to flow through the junction bypass. Undersizing the bypass pipe would cause the separator to fill with liquid while oversizing could result in significant vapor liquid phase splitting in the sump. To overcome this limitation, a level control could be used to insure that only the liquid phase flows in the junction bypass piping and thus eliminating the potential for oversizing the bypass. However, excellent performance has been obtained without resorting to level control or means other than sizing to limit vapor flow in the junction bypass.

The present invention may be subject to many modifications and changes, which will be apparent to one skilled in the art, without departing from the spirit or essential characteristics thereof. The present embodiment is therefore to be considered in all respects as illustrative and not restrictive of the scope of the invention as defined by the appended claims.

We claim:

1. A method to assure equal steam quality in all arms of a laterally symmetrical piping junction, comprising the steps of:

providing for the separation of the liquid and vapor phases of wet steam upstream of a laterally symmetrical junction with a vapor outlet connected to an inlet of said junction and conduit means connecting liquid phase from said separator to an inlet of said junction;

providing flow restriction means before said inlet;

flowing wet steam into said separator wherein the vapor phase will travel substantially axially therethrough exiting to said junction inlet; and allowing the liquid phase to separate and fall under gravity into a sump where it will flow by aspiration into said inlet vapor flow making the steam substantially homogeneous within the laterally symmetrical junction.

2. An apparatus for assuring homogeneous flow of wet steam through the arms of a laterally symmetrical piping junction comprising:

phase separation means having an inlet connected to a steam flow pipe and an outlet connected to said laterally symmetrical piping junction through a short outlet pipe, said phase separation means having a liquid phase collecting sump;

at least one conduit means connected between said sump and said laterally symmetrical piping junction; and flow restriction means in said outlet pipe whereby the liquid and vapor phases are separated in said separator and recombined just prior to entering the junction where they act substantially as homogenized wet steam.

3. The apparatus according to claim 2 wherein said constriction is an orifice.

4. The apparatus according to claim 2 wherein said constriction is a venturi.

5. The apparatus according to claim 2 wherein said separator is a section of pipe of substantially larger diameter than the feed pipe.

6. The apparatus according to claim 2 wherein said separator further comprises:

means to prevent liquid carryover out of said separator.

7. The apparatus according to claim 2 wherein the end of said bypass pipe is located substantially axially of the constriction.

8. The apparatus according to claim 2 wherein the end of said bypass pipe is profiled to enhance aspiration of the liquid phase passing therethrough.

* * * * *